US005843006A

United States Patent [19]

Phillips et al.

[11] Patent Number: 5,843,006

[45] Date of Patent: Dec. 1, 1998

[54] MASSAGING DEVICE

[76] Inventors: Reuben E. Phillips; Dorothy D. Phillips, both of 1050 Rock Quarry Rd., Apt. 30, Stockbridge, Ga. 30281

[21] Appl. No.: 729,987

[22] Filed: Oct. 11, 1996

[51] Int. Cl.[6] ..... A61H 7/00

[52] U.S. Cl. ..... 601/133; 601/134; 601/95; 601/103; 601/111

[58] Field of Search ..... 601/87, 89, 90, 601/92–95, 97–9, 101–4, 111, 133–7

[56] References Cited

U.S. PATENT DOCUMENTS

| | | | |
|---|---|---|---|
| 1,387,687 | 8/1921 | Chaussinand . | |
| 1,420,049 | 6/1922 | Mashek | 601/97 |
| 1,579,679 | 4/1926 | Wahrt . | |
| 2,038,846 | 4/1936 | Matson | 601/133 X |
| 2,067,991 | 1/1937 | Taylor | 128/55 |
| 2,232,493 | 2/1941 | Stuckey et al. | 601/133 X |
| 2,683,451 | 7/1954 | Clark | 128/24.1 |
| 3,993,052 | 11/1976 | Miyahara | 601/87 |
| 4,777,945 | 10/1988 | Curtaz et al. | 128/52 |
| 4,856,496 | 8/1989 | Chursinoff | 128/52 |
| 5,065,743 | 11/1991 | Sutherland | 128/60 |
| 5,085,207 | 2/1992 | Fiore | 128/32 |
| 5,159,922 | 11/1992 | Mabuchi et al. | 128/52 |
| 5,167,225 | 12/1992 | Cheng-I | 128/44 |
| 5,183,034 | 2/1993 | Yamasaki et al. | 128/36 |

FOREIGN PATENT DOCUMENTS

| | | | |
|---|---|---|---|
| 403251246 | 11/1991 | Japan | 601/92 |
| 531088 | 12/1940 | United Kingdom | 601/134 |

*Primary Examiner*—Danton D. DeMille
*Attorney, Agent, or Firm*—William R. Sharp

[57] ABSTRACT

A massaging device comprises a case; at least one pair of fingers having outer ends and being mounted within and extending from the case to the outer ends; a drive means; and a cam means operably connected to and driven by the drive means for actuating the pair of fingers to transversely reciprocate so that the outer ends move toward and away from one another. In the disclosed embodiments, the fingers are pivotally mounted and the cam means comprises a cam disk with at least one irregular surface.

2 Claims, 3 Drawing Sheets

MASSAGING DEVICE

BACKGROUND OF THE INVENTION

The invention relates to a massaging device, and more particularly a massaging device which uses at least one reciprocating pair of fingers.

Massaging devices are well known for use in relieving muscular aches, sprains, etc. Prior devices include vibrating, rotating, and thumping mechanisms for body massage. Such devices fail, however, in simulating the desirable kneading action of the human hand.

SUMMARY OF THE INVENTION

It is, therefore, an object of the invention to provide a massaging device which simulates the action of the human hand.

The above object is realized by a massaging device comprising: a case; at least one pair of fingers having outer ends and being pivotally mounted within and extending from the case to the outer ends; a drive means; and a cam means operably connected to and driven by the drive means for actuating the pair of fingers to pivotally and transversely reciprocate so that the outer ends move toward and away from one another.

According to another aspect of the invention there is provided a massaging device comprising: a case; at least one pair of fingers having outer ends and being mounted within and extending from the case to the outer ends; a drive means; and a cam disk having at least one irregular surface and being rotated by the drive means for actuating the pair of fingers to transversely reciprocate so that the outer ends move toward and away from one another.

The transverse reciprocation of the pair of fingers in accordance with the invention closely simulates the kneading action of the human hand, and is highly effective in relieving muscle aches, cramps, etc.

DETAILED DESCRIPTION OF THE INVENTION

Figure 1:
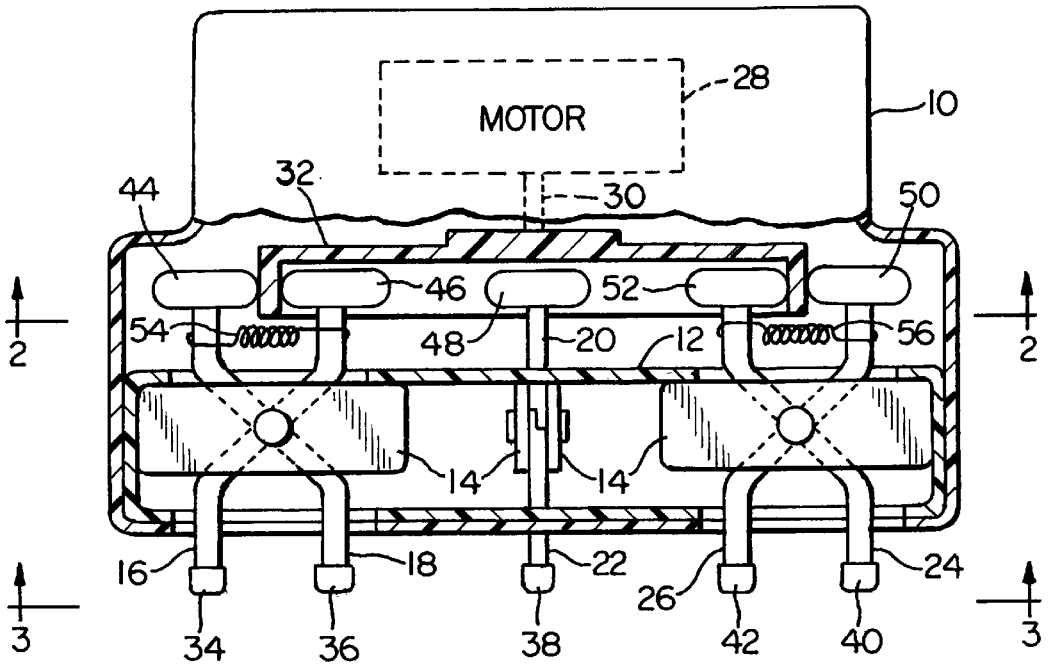
FIG. 1 is a view of one embodiment of the invention, wherein a portion of the device is broken away and shown in cross section.

Referring to FIG. 1, the illustrated device comprises: a case 10; an inner housing 12 having brackets 14 connected thereto; a first pair of fingers 16 and 18; a second pair of fingers 20 and 22; a third pair of fingers 24 and 26 (a fourth pair is not visible in FIG. 1); a drive means or motor shown schematically at 28; a drive shaft 30; and a cam disk 32 having a central hub fixedly connected to drive shaft 30. Motor 28 is adapted to rotate cam disk 32 at about 60–180 r.p.m. Motor 28 is preferably controllable to vary the r.p.m. of cam disk 32.

Each pair of fingers is pivotally connected between brackets 14. Each of the fingers extends from case 10 to outer ends which are exterior to the case. Each outer end preferably has a rubber tip as indicated at 34, 36, 38 (of which the opposing tip is not visible), 40, and 42. Each inner end of the fingers has a roller rotatably connected thereto, as indicated at 44, 46, 48 (of which the opposing roller is not visible), 50, and 52. As shown, a spring 54 is connected between fingers 16 and 18, and a spring 56 is connected between fingers 24 and 26. The spring connected between fingers 20 and 22 is not visible. Each such spring functions to bias the finger outer ends as well as the rollers toward one another.

Figure 2:
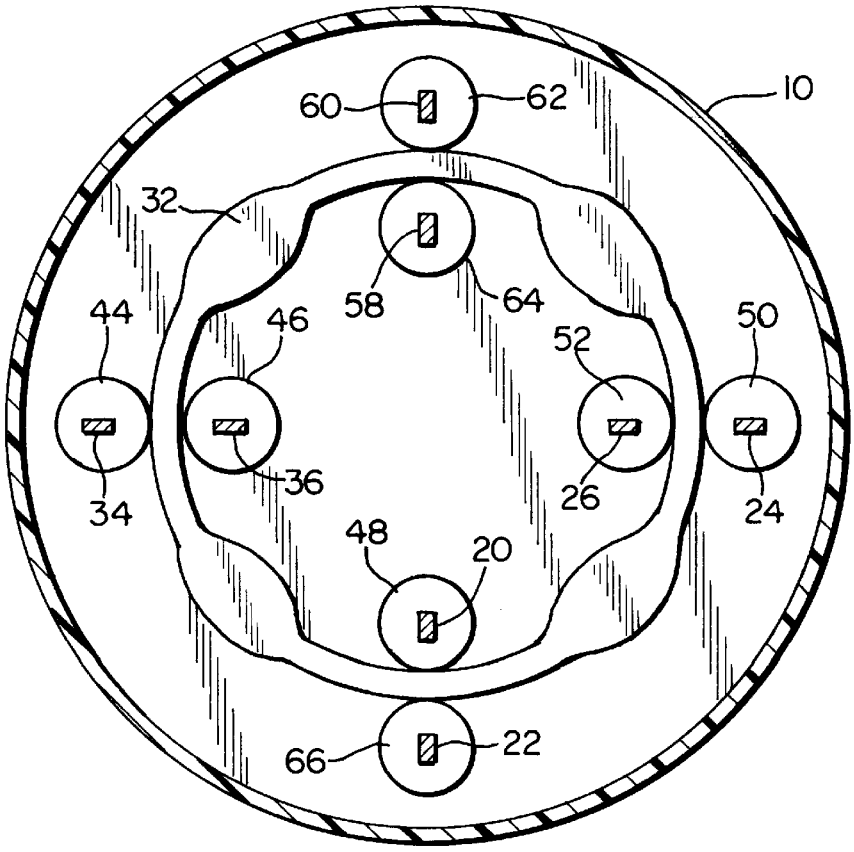
FIG. 2 is a cross-sectional view as viewed along line 2—2 in FIG. 1.

Referring now to FIG. 2, this cross-sectional view shows fingers 58 and 60, and rollers 62, 64, and 66, which are not visible in FIG. 1. Cam disk 32 can be seen to have an irregular inner surface and an irregular outer surface. Of each roller-pair, the inner roller contacts the inner surface of the cam disk and the outer roller contacts the outer surface.

Figure 3:
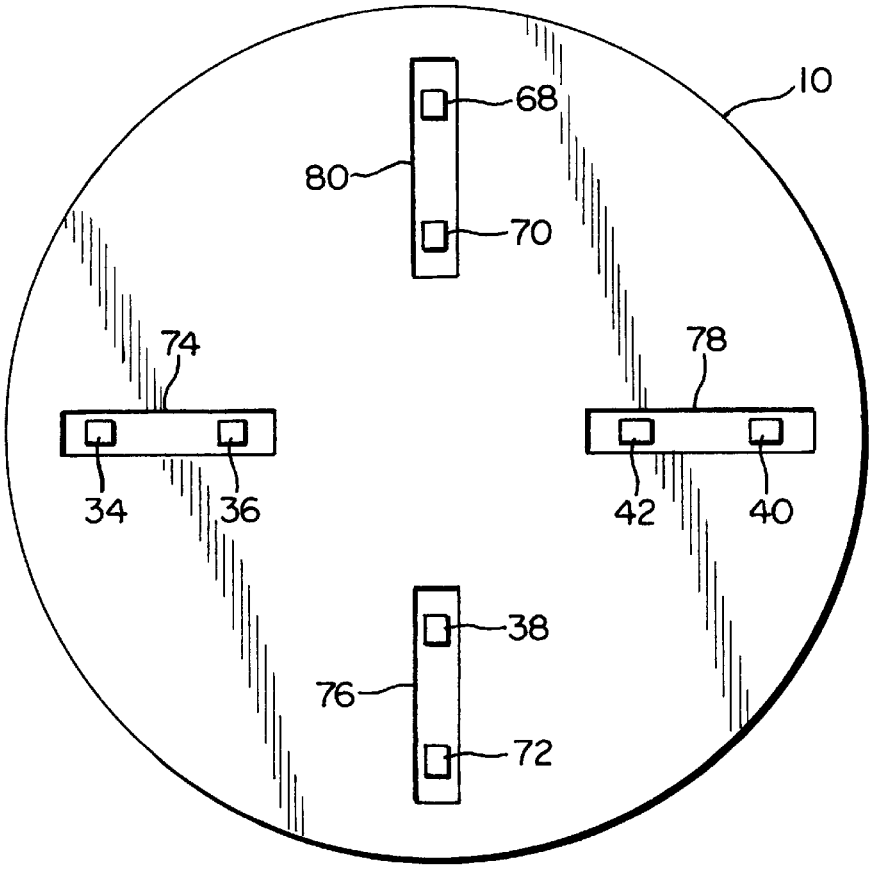
FIG. 3 is a cross-sectional view as viewed along line 3—3 in FIG. 1.

Referring now to FIG. 3, this view shows the tips of the fingers, including 34, 36, 38, 40, and 42, and also 68, 70, and 72 which are not visible in FIG. 1. Each pair of fingers has a corresponding slot through which the outer ends extend, as indicated at 74, 76, 78, and 80.

Figure 4:
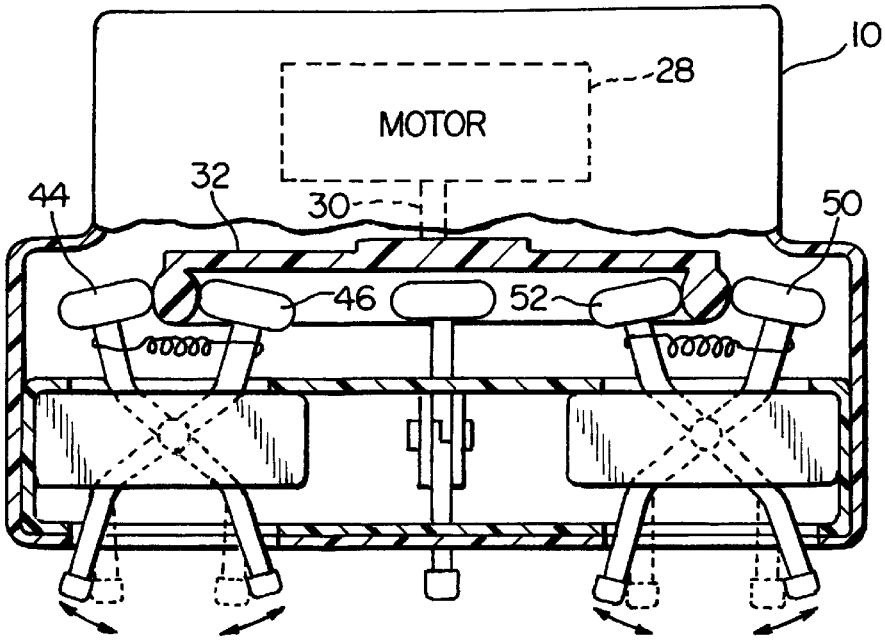
FIG. 4 view of the device of FIG. 1, having a cam disk, where the cam disk is shown in a different position with the pairs of fingers in different positions.

FIG. 4 more clearly shows the operation of the massaging device. Rotation of cam disk 32 moves the inner and outer irregular surfaces to the position shown in which enlarged portions are between rollers 44 and 46 and between rollers 50 and 52. Contact of the inner and outer surfaces with each roller-pair actuates each corresponding pair of fingers to pivotally and transversely undergo motion in which the outer ends move away from one another from the position in broken lines to the position in solid lines. Further rotation of cam disk 32 causes the outer ends of the fingers to move back toward one another. Accordingly, each pair of fingers pivotally and transversely reciprocate so that the outer ends move toward and away from one another. It can further be seen from FIG. 4 that the outer ends of the fingers define a circular arc as the fingers reciprocate.

The user typically operates the massaging device by grasping case 82 and applying the tips of the fingers to the area to be massaged.

Figure 5:
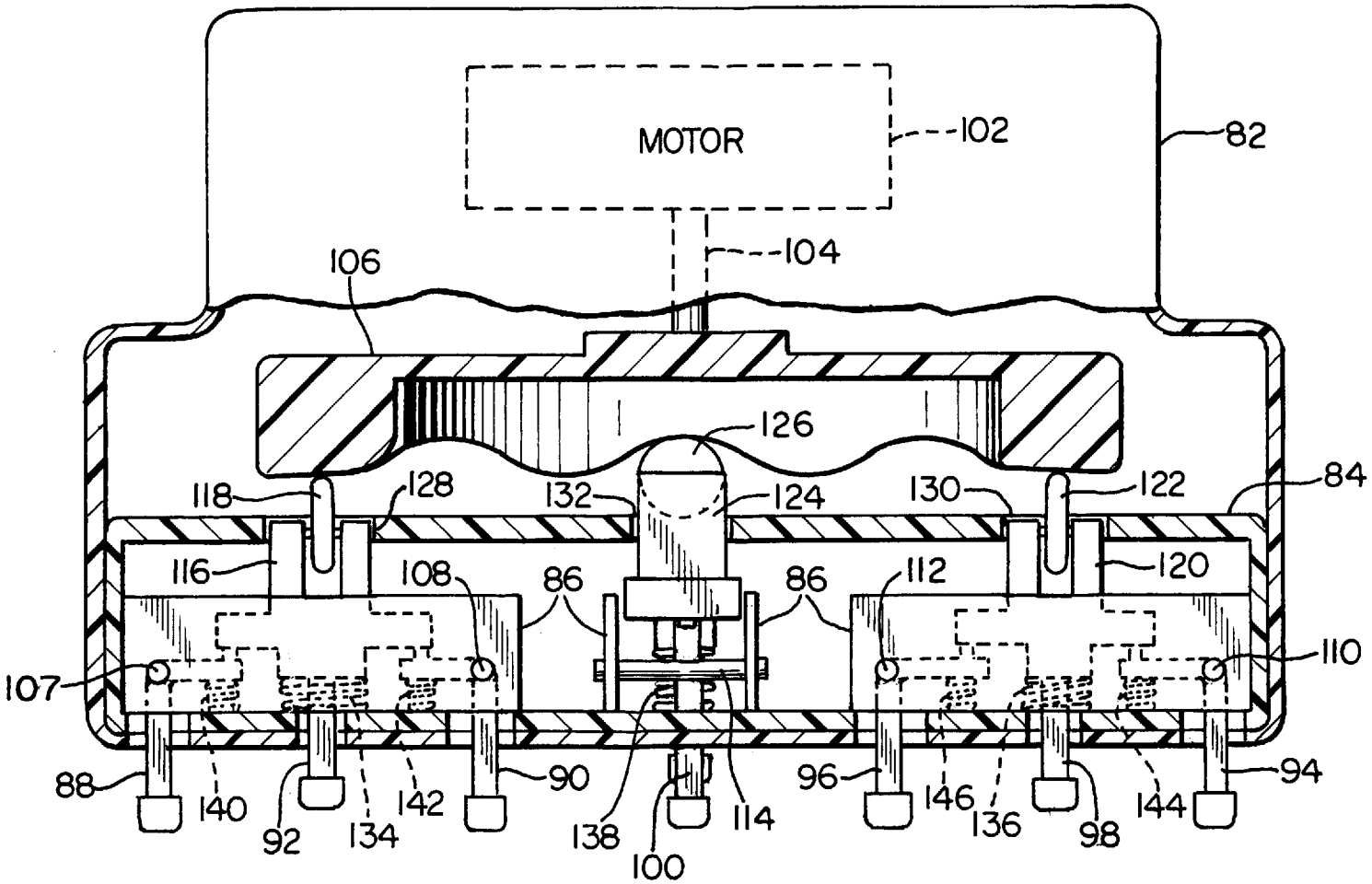
FIG. 5 is a view of another embodiment of the invention, wherein a portion of the device is broken away and shown in cross section.

Referring now to FIG. 5, an alternate embodiment of the invention comprises: a case 82; an inner housing 84 having brackets 86 connected thereto; a first set of fingers having a pair of fingers 88 and 90 and a third central finger 92; a second set of fingers having a pair of fingers 94 and 96 and a third central finger 98; a third set of fingers of which only finger 100 is visible (a fourth set is not visible in FIG. 5); a drive means or motor 102; a drive shaft 104; and a cam disk 106 having a central hub fixedly connected to drive shaft 104. Fingers 88, 90, 94, 96, and 100 are pivotally mounted between brackets by means of pivot arms 107, 108, 110, 112, and 114, respectively, which are integral with the fingers and extend between brackets 86. Each set of fingers is actuated by means of a boss which is received between brackets 86.

Boss 116 is operably connected to fingers 88 and 90, and has a roller 118 rotatably connected thereto for contacting the irregular surface of cam disk 106. Boss 120 is operably connected to fingers 94 and 96, and has a roller 122 rotatably connected thereto for contacting the irregular surface of cam disk 106. Boss 124 is operably connected to finger 100 and a nonvisible finger, and has a roller 126 rotatably connected thereto for contacting the irregular surface of cam disk 106. Each of central fingers 92 and 98 is integral with its respective boss. Each boss 116, 120, and 124 is closely received through a corresponding opening 128, 130, and 132 in inner housing 84. Springs 134, 136, and 138 respectively bias boss 116, boss 120, and boss 124 toward cam disk 106. Springs 140 and 142 bias fingers 88 and 90 to urge the outer ends of the fingers toward one another. Springs 144 and 146 similarly bias fingers 94 and 96 to urge the outer ends of the fingers toward one another.

In operation, fingers 88, 90, 94, 96, and 100 transversely reciprocate, while fingers 92 and 98 axially reciprocate.

The components of each embodiment are preferably comprised of a substantially rigid plastic, such as polyvinyl chloride. The rollers preferably have a plastic core and a natural or synthetic rubber exterior fused to the core. obviously, many modifications and variations of the present invention are possible in light of the above teachings. It is, therefore, to be understood the within the scope of the appended claims, the invention can be practiced otherwise than as specifically described.

That which is claimed is:

1. A massaging device comprising:

a case;

at least one pair of fingers having outer ends and being pivotally connected to one another within the case such that the fingers extend from the case to the outer ends;

a biasing means for biasing the outer ends of the fingers toward or away from one another;

a drive means;

a cam disk having an inner irregular surface and an outer irregular surface and being operably connected to and driven by the drive means to cause rotation thereof;

an inner roller rotatably connected to one finger and an outer roller rotatably connected to the other finger, the inner roller contacting the inner irregular surface and the outer roller contacting the outer irregular surface such that rotation of the cam disk causes the pair of fingers to pivotally and transversely reciprocate with the outer ends moving toward and away from one another so as to define a circular arc.

2. A massaging device comprising:

a case;

at least one pair of fingers having outer ends and being pivotally mounted within and extending from the case to the outer ends;

at least one third finger;

a drive means;

a cam disk having a singe irregular surface and being operably connected to and driven by the drive means to cause rotation thereof;

at least one boss operably connected to the pair of fingers, the third finger being integral with the boss;

at least one roller rotatably connected to the boss and positioned to contact the irregular surface such that rotation of the cam disk causes the pair of fingers to pivotally and transversely reciprocate with the outer ends moving toward and away from one another. the third finger being actuated by the cam disk to axially reciprocate.

* * * * *